US010161618B2

(12) United States Patent
Quadri

(10) Patent No.: US 10,161,618 B2
(45) Date of Patent: Dec. 25, 2018

(54) STAGE LIGHT FIXTURE

(71) Applicant: CLAY PAKY S.p.A., Seriate (IT)

(72) Inventor: Aris Quadri, Seriate (IT)

(73) Assignee: CLAY PAKY S.P.A., Seriate (IT)

( * ) Notice: Subject to any disclaimer, the term of this patent is extended or adjusted under 35 U.S.C. 154(b) by 0 days.

(21) Appl. No.: 15/282,071

(22) Filed: Sep. 30, 2016

(65) Prior Publication Data

US 2017/0097151 A1 Apr. 6, 2017

(30) Foreign Application Priority Data

Oct. 2, 2015 (IT) ..... 102015000057699

(51) Int. Cl.

| | |
|---|---|
| ***F21V 29/00*** | (2015.01) |
| ***F21V 29/67*** | (2015.01) |
| ***F21V 29/503*** | (2015.01) |
| ***F21V 29/61*** | (2015.01) |
| *F21W 131/406* | (2006.01) |
| *H01J 61/98* | (2006.01) |

(52) U.S. Cl.

CPC ..... *F21V 29/673* (2015.01); *F21V 29/503* (2015.01); *F21V 29/61* (2015.01); *F21V 29/677* (2015.01); *F21W 2131/406* (2013.01); *H01J 61/98* (2013.01)

(58) Field of Classification Search

CPC ..... F21V 29/503; F21V 29/67; F21V 29/673; F21V 29/677; F21W 2131/406; H01J 61/52; H01J 61/523; H01J 61/526

See application file for complete search history.

(56) References Cited

U.S. PATENT DOCUMENTS

| | | | | |
|---|---|---|---|---|
| 4,405,882 | A * | 9/1983 | Reinsch | F21V 29/02 116/273 |
| 2004/0145896 | A1* | 7/2004 | Watanabe | F21V 29/02 362/294 |
| 2006/0256296 | A1 | 11/2006 | Yun et al. | |
| 2008/0083527 | A1* | 4/2008 | Horng | H05K 7/20972 165/80.3 |
| 2010/0177282 | A1* | 7/2010 | Nakajima | G03B 21/16 353/61 |
| 2013/0223078 | A1 | 8/2013 | Quadri et al. | |

FOREIGN PATENT DOCUMENTS

| | | |
|---|---|---|
| EP | 1 647 766 | 4/2006 |
| EP | 2623860 A1 | 8/2013 |
| WO | 2011119451 A1 | 9/2011 |

* cited by examiner

*Primary Examiner* — Sean Gramling

(74) *Attorney, Agent, or Firm* — Leason Ellis LLP

(57) ABSTRACT

A stage light fixture is provided with a light source and with a cooling assembly configured to cool the light source; the cooling assembly comprises at least one cooling device configured to generate a flow of cooling air through an outlet opening having an elongated shape along a main axis.

12 Claims, 3 Drawing Sheets

STAGE LIGHT FIXTURE

CROSS-REFERENCE TO RELATED PATENT APPLICATIONS

The present application claims the benefit of priority under 35 U.S.C. § 119 of Italian Patent Application No. 102015000057699, filed Oct. 2, 2015, which is hereby incorporated by reference in its entirety.

TECHNICAL FIELD

The present invention relates to a stage light fixture.

BACKGROUND OF THE INVENTION

The stage light fixtures of known type comprise at least one light source configured to generate a light beam and a plurality of light beam processing elements configured to selectively process the light beam in accordance with the scene requirements. The light source and the light beam processing elements are generally housed in a casing and generate heat inside the casing.

The heat accumulated inside the casing can overheat the light source and the remaining components of the light fixture, thus risking a permanent damage. For these reasons, most of the stage light fixtures include a cooling assembly able to remove the heat generated inside the casing. However, the normally used cooling assemblies are not always able to correctly cool the light source.

Sometimes, in fact, the cooling is insufficient or excessive, with irreparable consequences that imply a reduction in the duration of the light source and sometimes even the breakage of the light source.

SUMMARY OF THE INVENTION

It is therefore an object of the present invention to provide a stage light fixture that is free from the aforesaid prior art drawbacks.

In particular, it is an object of the present invention to provide a stage light fixture that is provided with a cooling assembly to suitably cool the light source during the use, thus ensuring an adequate durability and reliability.

In accordance with these objects, the present invention relates to a stage light fixture comprising a light source and a cooling assembly to cool the light source, the cooling assembly comprising at least a cooling device configured to generate a cooling air flow through an outlet opening; the outlet opening having an elongated shape along a main axis.

Advantageously, an elongated outlet opening generates a cooling air flow distributed along the main axis. This substantially creates an oriented cooling air curtain, which is able to appropriately cool the light source.

According to a preferred embodiment of the present invention, the cooling device comprises at least one fan. In this way, the air flow leaving the outlet opening might have the adequate and optimal speed to achieve the desired cooling.

According to a preferred embodiment of the present invention, the cooling device comprises a tangential fan provided with at least one impeller, rotating about a rotation axis. The obtained air flow is therefore tangent with respect to the outer diameter of the impeller. In this way, the flow generated by the impeller can be easily oriented through the outlet opening.

According to a preferred embodiment of the present invention, the impeller has a length (measured along the rotation axis) greater than the diameter (perpendicular to the rotation axis). In this way, the impeller can generate an air curtain.

According to a preferred form of the present invention, the length of the impeller (measured along the rotation axis) is substantially equal to the length of the outlet opening (measured along the main axis). In this way, substantially the whole flow generated by the impeller can be easily oriented through the outlet opening.

According to a preferred form of the invention, the light fixture comprises a further cooling device configured to generate a further flow of cooling air through a further outlet opening; the further outlet opening having an elongated shape along a further main axis. In this way, the cooling assembly is able to generate a further distributed flow of cooling air. This substantially creates a further cooling air curtain, suitable oriented and further cooling the light source.

According to a preferred form of the invention, the further cooling device comprises at least one further tangential fan, further comprising a further impeller rotating about a further rotation axis. In this way, the further air flow obtained is tangent with respect to the outer diameter of the further impeller and can be easily oriented through the further outlet opening.

According to a preferred form of the invention, the further impeller has a length (measured along the further rotation axis) greater than the diameter (perpendicular to the further rotation axis); the length of the further impeller (measured along the further rotation axis) is substantially equal to the length of the further outlet opening (measured along the further main axis). In this way, the further impeller can generate a cooling air curtain, which is easily oriented through the outlet opening.

According to a preferred embodiment of the present invention, the cooling device is arranged so that the flow of cooling air passing through the outlet is directed towards at least a first portion of the light source and the further cooling device is arranged in such a way that the further flow of cooling air passing through the further outlet opening is oriented towards at least a second portion of the light source. In this way, the light source is evenly cooled through two cooling air flows.

According to a preferred form of the invention, the first portion of the light source comprises at least a basis and a rear tubular portion of a short arc lamp, and the second portion of the light source comprises at least one front tubular portion of a short arc lamp. In this way the cooling assembly can cool completely and smoothly a short arc lamp.

According to a preferred form of the invention, the light fixture comprises a control device configured to regulate the cooling assembly. The cooling assembly is thus suitably regulated to optimize the cooling of the source without waste.

According to a preferred form of the invention, the control device is configured to regulate the cooling assembly depending on the operating conditions of the light fixture. In this way, the control device avoids any overheating or overcooling typical of some operating conditions of the light fixture, thus avoiding thermal stress to the light source.

According to a preferred form of the invention, the control device is configured to regulate the cooling assembly depending on the operating position of a dimmer. The control device therefore controls the cooling assembly based on the intensity of the light beam generated by the source, thus avoiding any overheating and overcooling.

According to a preferred form of the invention, the control device is configured to regulate the cooling assembly depending on the power supply of the light source. The control device therefore controls the cooling assembly based on the intensity of the light beam generated by the source, thus avoiding any overheating and overcooling.

According to a preferred form of the invention, the control device is configured to regulate the cooling assembly depending on the type and position of a beam processing element to selectively intercept a light beam emitted from the light source. In this way, the control device regulates the cooling assembly depending on whether the light beam is intercepted by beam processing elements (for example, colour filters) that can alter the temperature conditions of the light source.

BRIEF DESCRIPTION OF THE DRAWINGS

Further characteristics and advantages of the present invention will become clear from the following description of an example of a not limiting embodiment, with reference to the figures of the accompanying drawings, wherein.

DETAILED DESCRIPTION OF THE INVENTION

Figure 1:
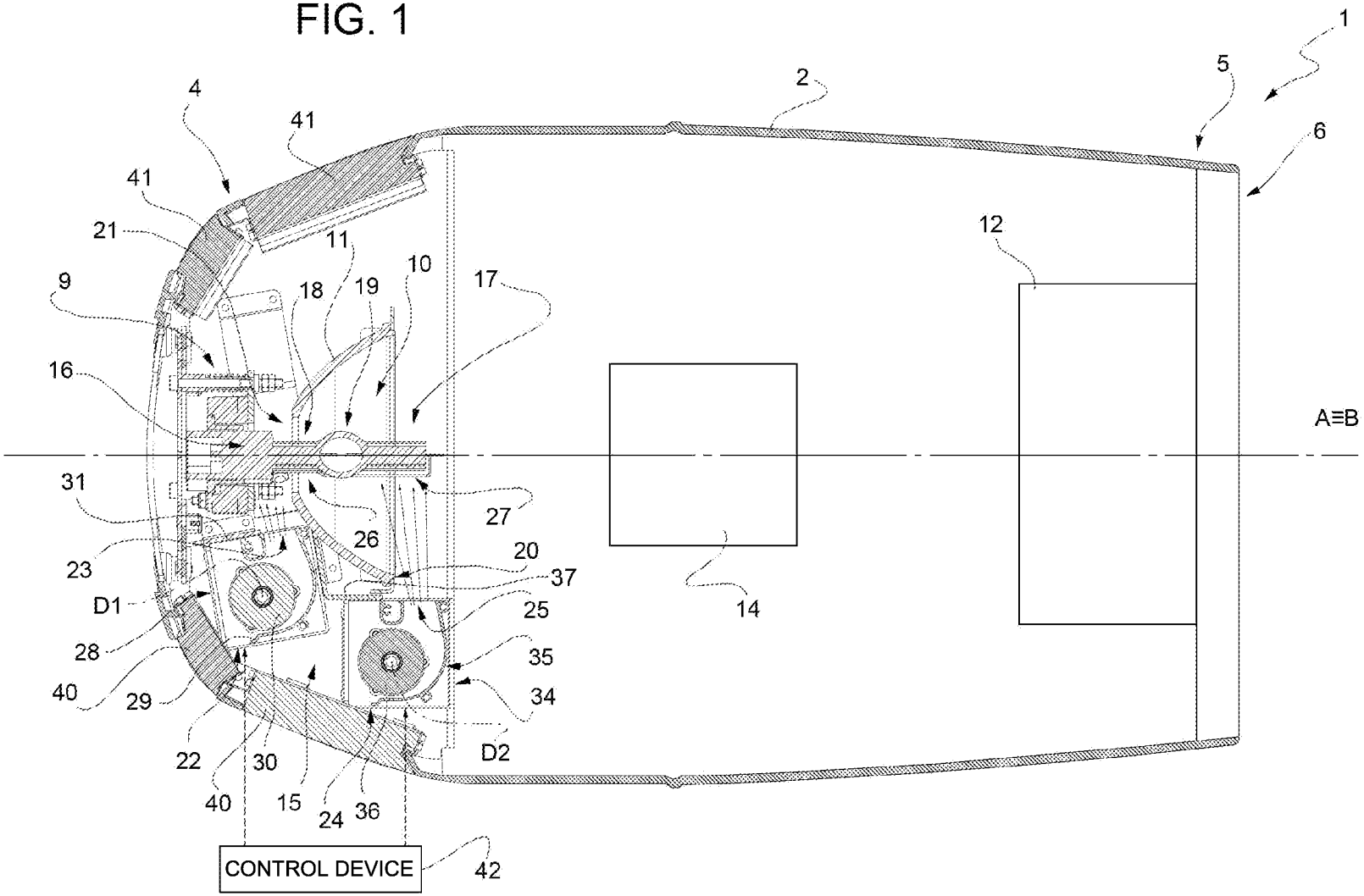
FIG. 1 is a schematic side view, with parts in section and parts removed for clarity's sake, of a light fixture according to the present invention.

FIG. 1 indicates with the reference number 1 a stage light fixture comprising a casing 2 and support means (not shown in the accompanying figures) configured to support the casing 2. Preferably, the support means are configured for moving the casing 2 and for allowing its rotation about two orthogonal axes, commonly said PAN and TILT. The operation of the support means is regulated by a motion control device (not shown in the accompanying figures). The motion control device can also be operated remotely, preferably by communicating through a DMX protocol.

According to a variant, the support means may be configured only to support the casing 2, without moving it.

The casing 2 extends along a longitudinal axis A and is provided with a first closed end 4 and with a second end 5, opposite to the first closed end 4 along the axis A, and provided with a projection opening 6. In the non-limiting example here described and shown, the projection opening 6 has a substantially circular section.

The light fixture 1 also comprises a frame 9 coupled to the casing 2 (partially shown in FIG. 1 and FIG. 2), a light source 10, a reflector 11, an optical assembly 12 (schematically shown in FIG. 1), light beam processing means 14 (schematically shown in FIG. 1) and a cooling assembly 15.

Figure 2:
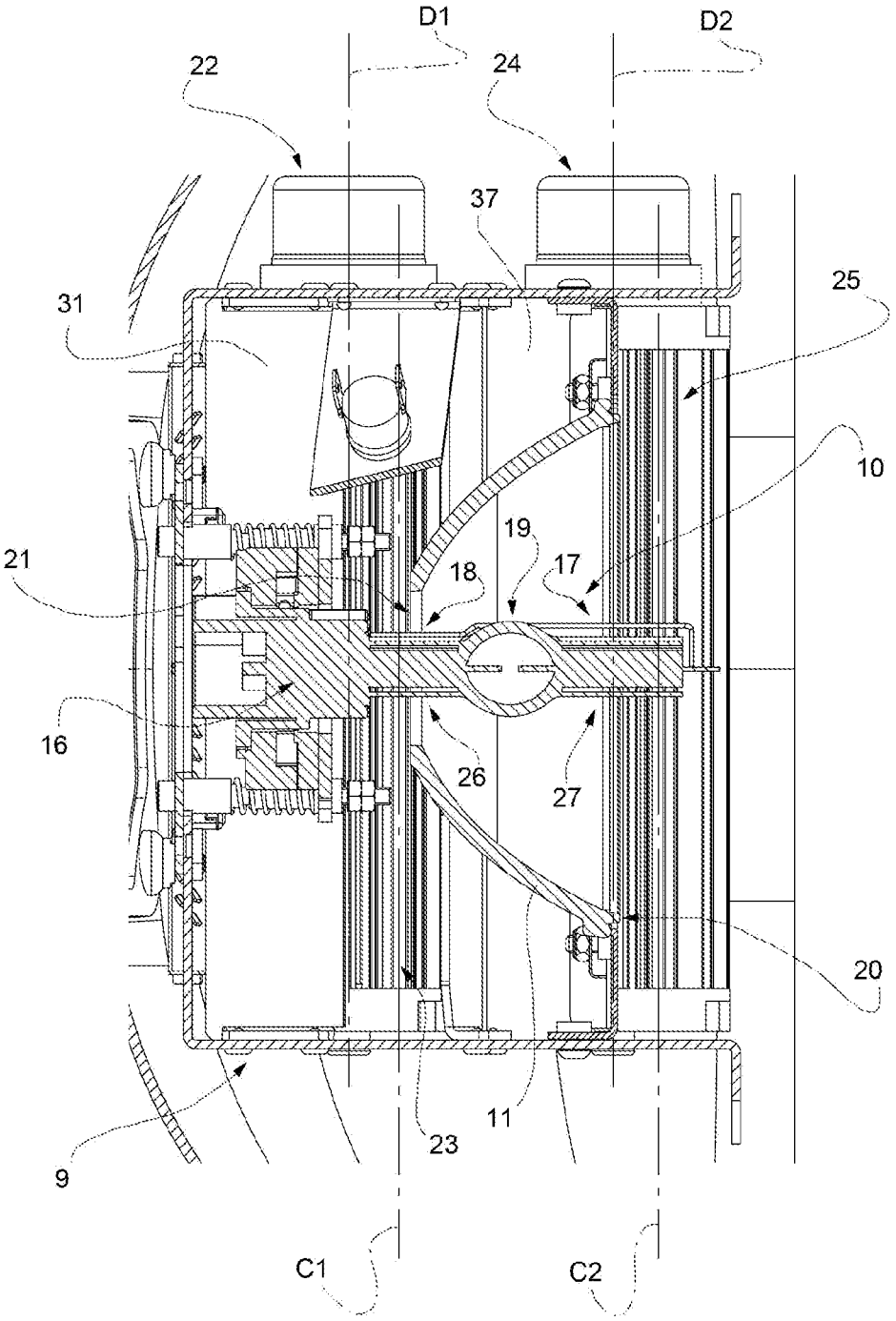
FIG. 2 is a schematic top view, with parts in section and parts removed for clarity's sake, of a first detail of the light fixture of FIG. 1.

The frame 9 is integral with the casing 2 and comprises a plurality of elements coupled to each other and configured to define a support structure for the components arranged within the casing 2, such as the light source 10, the reflector 11, the optical unit 12, the beam processing means 14 and the cooling assembly 15. FIG. 1 and FIG. 2 partially show some of the frame elements 9 configured to support the light source 10, the reflector 11 and, as described in more detail hereinafter, the cooling assembly 15.

With reference to FIG. 1 and to FIG. 2, the light source 10 is arranged inside the casing 2 at the closed end 4 of the housing 2, is supported by the frame 9, and emits a light beam substantially along an optical axis B.

In the non-limiting example here described and shown, the optical axis B coincides with the longitudinal axis A of the housing 2.

The light source 10 is preferably a discharge lamp, preferably made of glass or quartz and containing mercury and halides.

The discharge lamp is preferably a short arc lamp extending along the optical axis B and comprising an attachment basis 16, a front tubular portion 17, a rear tubular portion 18, axially opposite to the front tubular portion 17 and coupled to the basis 16, and a central bulb 19 arranged between the front tubular portion 17 and the rear tubular portion 18.

Inside the bulb 19 there are two electrodes connected to a power supply circuit (not shown in the accompanying Figures) and mutually spaced at a determined distance. The distance between the electrodes is less than approximately 6 mm. In the non-limiting example here described and shown this distance is about 5.5 mm.

In the non-limiting example here described and shown, the short arc lamp has a power greater than about 1000 watts. In the non-limiting example here described and shown, the lamp power is about 1200-1400 watts.

The reflector 11 is a preferably elliptical reflector, coupled to the light source 10 and having an outer edge 20.

Preferably, the reflector 11 is provided with a central hole 21 housing the rear tubular portion 18 of the light source 10.

With reference to FIG. 1, the optical unit 12 is arranged at the open end 5 of the housing 2, is centred on the optical axis B, is the last unit able to process the intercepted light beam and, preferably, closes the casing 2.

The optical unit 12 includes one or more lenses (not shown in the attached figures). Preferably, the optical unit 12 is configured to regulate the zoom of the light beam and to focus on the projected image.

The light beam processing means 14 comprise a plurality of light beam processing elements 9 supported by the frame and configured to process the light beam generated by the light source 10 so as to obtain particular effects. In particular, the beam processing elements are supported and/or configured to selectively intercept the light beam in order to change the light beam only if necessary. In other words, the beam processing elements can intercept the beam to change its properties only if necessary. The location of each of the beam processing elements is regulated by a control device of the beam processing elements (not shown in the accompanying figures). The control device of the beam processing elements can also be operated remotely, preferably by communicating through a DMX protocol.

The light beam processing means 14 may include one or more processing elements selected from the group comprising a dimmer, a colour group, a gobos device, a rainbow device, an effect wheel, a frost group and a prismatic element. Obviously, the light beam processing means 14 may include further beam processing elements not listed here.

With reference to FIGS. 1 and 2, the cooling assembly 15 comprises at least one cooling device 22 configured to generate a flow of cooling air through an outlet opening 23 having an elongated shape along a main axis C1.

In particular, the outlet opening 23 is characterized by a length LB measured along the main axis C1 corresponding to at least twice the height perpendicular to the main axis C1. In the non-limiting example here described and shown, the length LB of the outlet opening 23 is more than about six times the height.

Preferably, the outlet opening has a rectangular shape elongated along the main axis C1.

In the non-limiting example here described and shown, the rotation axis D1 is parallel to the main axis C1.

In the non-limiting example here described and shown, the cooling assembly 15 comprises a further cooling device 24, configured to generate a further flow of cooling air through a further outlet opening 25 having an elongated shape along a further main axis C2. In particular, the further outlet opening 23 is characterized by a length measured along the further main axis C2 corresponding to at least twice the height perpendicular to the further main axis C2. In the non-limiting example here described and shown, the length of the further outlet opening 23 is more than about six times the height.

Preferably, the further outlet opening has a rectangular shape, elongated along the further main axis C2.

In the non-limiting example here described and shown, the further rotation axis D2 is parallel to the further main axis C2.

In particular, the cooling device 22 is arranged so that the flow of cooling air passing through the outlet 23 (schematically shown by the arrows in FIG. 1) is directed at least on a first portion 26 of the light source 10, and the further cooling device 24 is arranged so that the further flow of cooling air passing through the further outlet opening 25 (schematically shown by the arrows in FIG. 1) is directed at least on a second portion 27 of the light source 10.

Preferably, the first portion 26 of the light source 10 comprises at least the basis 16 and the rear tubular portion 18 of the short arc lamp, while the second portion 27 comprises at least the front tubular portion 17 of the short arc lamp.

With reference to FIGS. 1 and 2, the cooling device 22 is supported by the frame 9 so that the outlet opening is close to the hole 21 of the reflector 11. In this way, the flow of cooling air leaving the outlet opening 23 passes through the hole 21 of the reflector 11 and directly reaches the basis 16, the rear tubular portion 18 of the short arc lamp and preferably also the bulb 19.

The cooling device 24 is, on the other hand, supported by the frame 9 so that the further outlet opening 25 is close to the outer edge 20 of the reflector 11. In this way, the flow of cooling air leaving the outlet opening 23 laps the outer edge 20 of the reflector 11 and reaches directly the front tubular portion 17 of the short arc lamp and preferably also the bulb 19.

Figure 3:
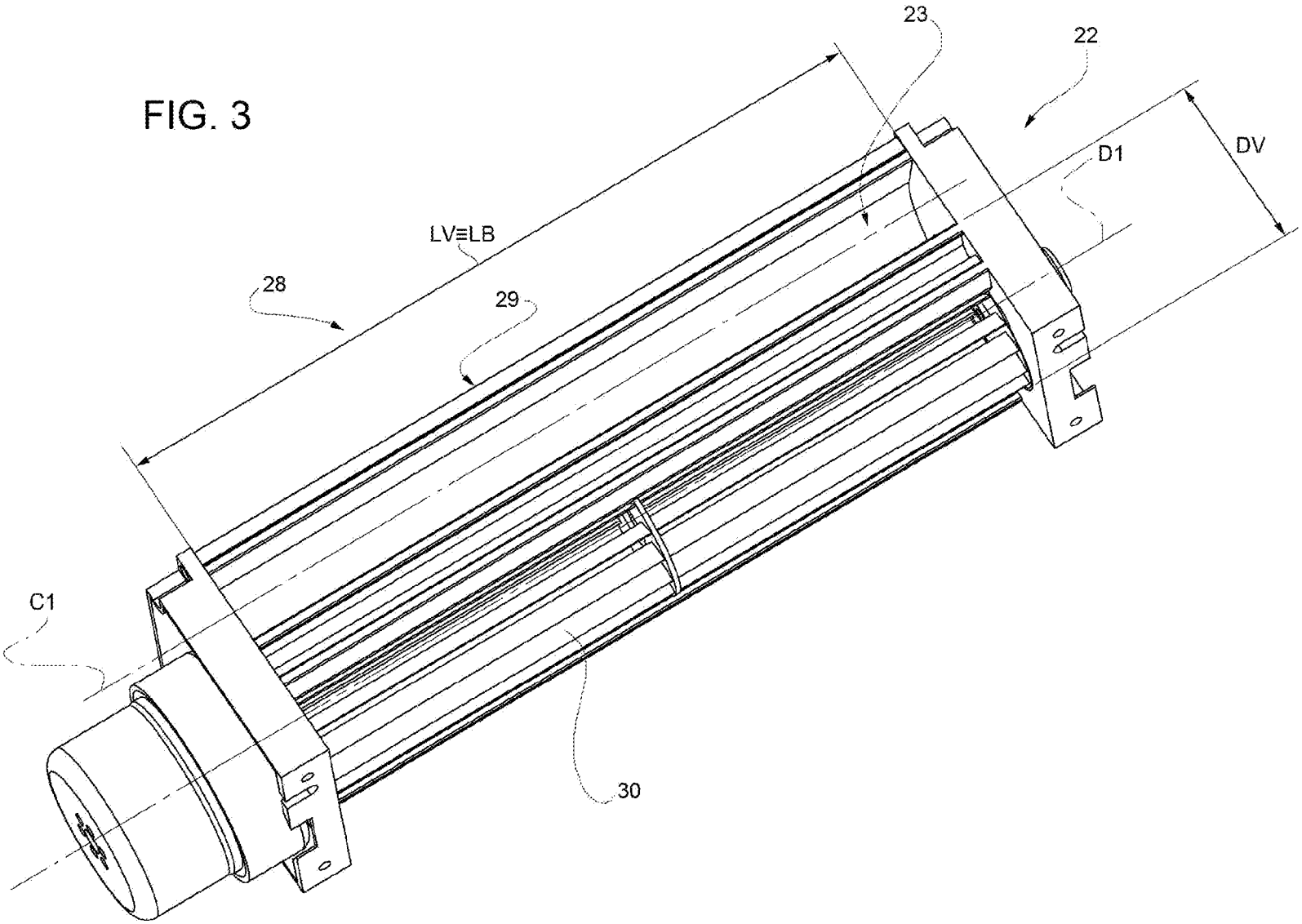
FIG. 3 is a perspective view, with parts removed for clarity's sake, of a detail of FIG. 2.

With reference to FIG. 3, the cooling device 22 comprises a tangential fan 28 including a diffuser 29 and an impeller 30, rotatable about a rotation axis D1 and arranged inside the diffuser 29.

The diffuser 29 defines the outlet opening 23. The impeller 30 is configured to generate an air flow substantially tangent to its outer diameter and has a length LV (measured along the rotation axis D1) greater than the diameter DV (perpendicular to the rotation axis D1).

In particular, the length LV of the impeller 30 (measured along the rotation axis D1) is substantially equal to the length LB of the outlet opening 23 (measured along the main axis C1). In the non-limiting example here described and shown, the diffuser 29 is coupled to a plate 31 shown in FIG. 1 and in FIG. 2. The plate 31 is fixed to the frame 9 and is configured to perform substantially two functions: supporting the tangential fan 28 and creating a kind of barrier between the suction area of the tangential fan 28 and the ejection area of the cooling air through the outlet opening 23.

Preferably, the further cooling device 24 (shown in FIGS. 1 and 2) is substantially identical to the cooling device 22 and therefore comprises a further tangential fan 34, comprising a further diffuser 35 and a further impeller 36, rotatable about a further rotation axis D2 and arranged inside the further diffuser 35.

The further diffuser 35 defines the further outlet opening 25. The further impeller 36 is configured to generate a further air flow, substantially tangent to its outer diameter, and has a length (measured along the further rotation axis D2) greater than the diameter (perpendicular to the further rotation axis D2). In particular, the length of the further impeller 36 (measured along the further rotation axis D2) is substantially equal to the length of the further outlet opening 25 (measured along the further main axis C2.)

In the non-limiting example here described and shown, the further diffuser 35 is coupled to a further plate 37 shown in FIG. 1 and in FIG. 2. The plate 37 is fixed to the frame 9 and is configured to perform substantially two functions: supporting the tangential fan 34 and creating a kind of barrier between the suction area of the tangential fan 34 and the ejection area of the cooling air through the outlet opening 25.

As shown in FIG. 1, the cooling devices 22 and 24 are housed in the casing 2. In particular, the casing 2 is provided with two intake air vents 40 close to the cooling devices 22 and 24 and with two exhaust air vents 41 arranged on the opposite side of the intake air vents with regard to the longitudinal axis A.

The cooling assembly 15 is regulated by a control device 42, shown schematically in FIG. 1.

In particular, the control device 42 is configured to regulate the speed of rotation of the impeller 30 and of the impeller 36 depending on the operating conditions of the light fixture 1.

Preferably, the control device 42 is configured to regulate the voltage supply of the impellers 30 and 36 in order to obtain a speed variation.

Preferably, the control device 42 is configured to lower the voltage supply of the impellers 30 and 36 when the dimmer is operated so as to reduce the brightness of the light beam. Preferably, the lowering of the voltage supply of the impellers 30 and 36 is a step change.

According to a variant, the control device 42 is configured to regulate the voltage supply of the impellers 30 and 36 depending on the power supply of the light source 10.

According to a further variant, the control device 42 is configured to regulate the voltage supply of the impellers 30 and 36 depending on the type and on the position of the beam processing element intercepting the light beam.

According to a further variant, the control device 42 is configured to regulate the speed of rotation of the impeller 30 and of the impeller 36 depending on the temperature conditions detected within the casing 2 or close to the light source 10.

According to a further variant, the control device 42 is configured to regulate the speed of rotation of the impeller 30 and of the impeller 36 depending on the orientation of the light fixture 1.

Preferably, the control device 42 is configured to regulate the speed of rotation of the impeller 30 and of the impeller 36 independently. In this way, the cooling air flow can be adapted to the needs of different types of light source 10.

Finally, the control device 42 is preferably configured also to regulate the direction of rotation of the impeller 30 and of the impeller 36 independently. In this way, it is possible to define, for example, a forced recirculation of the cooling air if the impeller 30 and the impeller 36 have an opposite direction of rotation, or a turbulent flow of the cooling air if the direction of rotation of the impellers 30 and 36 intermittently changes.

Finally, it is evident that the aforesaid light fixture may be modified and varied without departing from the scope of the appended claims.

The invention claimed is:

1. Stage light fixture comprising a light source and a cooling assembly for cooling the light source; the cooling assembly comprising at least one cooling device configured to produce a cooling air flow through an outlet opening; the outlet opening having an elongated shape along a main axis (C1; C2);

a control device configured to regulate the cooling assembly;

wherein the control device is configured to regulate the cooling assembly depending on the operating conditions of the light fixture; and at least one light beam processing element configured to selectively intercept the light beam of the light source; the control device being configured to regulate the cooling assembly depending on the type and position of the light beam processing element.

2. Light fixture according to claim 1, wherein the cooling device comprises at least one fan;

wherein the fan is a tangential fan comprising at least one impeller rotating about a rotation axis (D1; D2).

3. Light fixture according to claim 1, wherein the impeller has a length measured along the rotation axis (D1; D2) greater than the diameter perpendicular to the rotation axis (D1; D2).

4. Light fixture according to claim 3, wherein the length of the impeller measured along the rotation axis (D1; D2) is substantially equal to the length of the outlet opening measured along the main axis (C1; C2).

5. Light fixture according to claim 1, comprising a further cooling device configured to produce a further cooling air flow through a further outlet opening; the further outlet opening having an elongated shape along a further main axis (C2; C1).

6. Light fixture according to claim 5, wherein the further cooling device comprises at least one further fan.

7. Light fixture according to claim 6, wherein the further fan is a tangential fan comprising at least one further impeller rotating about a further rotation axis (D2; D1).

8. Light fixture according to claim 7, wherein the further impeller has a length measured along the further rotation axis (D2; D1) greater than the diameter perpendicular to the further rotation axis (D2; D1).

9. Light fixture according to claim 8, wherein the length of the further impeller measured along the further rotation axis (D2; D1) is substantially equal to the length of the further outlet opening measured along the further main axis (C2; C1).

10. Light fixture according to claim 7, wherein the cooling device is arranged so that the cooling air flow flowing through the outlet opening is directed at least towards a first portion of the light source and the further cooling device is arranged so that the further cooling air flow flowing through the further outlet opening is directed at least towards a second portion of the light source.

11. Light fixture according to claim 10, wherein the first portion of the light source comprises at least a basis and a rear tubular portion of a short arc lamp.

12. Light fixture according to claim 10, wherein the second portion of the light source comprises at least a front tubular portion of a short arc lamp.

* * * * *